US007549236B2

(12) United States Patent
Dillon et al.

(10) Patent No.: US 7,549,236 B2
(45) Date of Patent: Jun. 23, 2009

(54) FOOTWEAR WITH INDEPENDENT SUSPENSION AND PROTECTION

(75) Inventors: Peter Dillon, Topsfield, MA (US); Alexander Dardinski, Newburyport, MA (US); David L. Vattes, Londonderry, NH (US)

(73) Assignee: New England Footwear, LLC, Portsmouth, NH (US)

( * ) Notice: Subject to any disclaimer, the term of this patent is extended or adjusted under 35 U.S.C. 154(b) by 454 days.

(21) Appl. No.: 11/433,036

(22) Filed: May 12, 2006

(65) Prior Publication Data

US 2007/0209230 A1 Sep. 13, 2007

Related U.S. Application Data

(60) Provisional application No. 60/781,126, filed on Mar. 9, 2006.

(51) Int. Cl.
*A43B 13/18* (2006.01)

(52) U.S. Cl. ..... 36/30 R; 36/25 R; 36/59 R; 36/28

(58) Field of Classification Search ..... 36/27, 36/28, 25 R, 30 R, 102, 59 R
See application file for complete search history.

(56) References Cited

U.S. PATENT DOCUMENTS

| | | | | |
|---|---|---|---|---|
| 554,988 | A | 2/1896 | Cushing | |
| 1,670,747 | A | 9/1928 | Sestito | |
| 2,434,770 | A | 1/1948 | Lutey | |
| 2,468,886 | A | 5/1949 | Lutey | |
| 2,471,113 | A | 5/1949 | Melehionna | |
| 2,710,461 | A | 6/1955 | Hack | |
| 2,930,149 | A | 3/1960 | Hack | |
| 2,941,317 | A | 6/1960 | Hack | |
| 2,986,825 | A | 6/1961 | Moore | |
| 3,271,885 | A | 9/1966 | McAuliffe | |
| 3,466,763 | A | 9/1969 | Levin | |
| D235,700 | S | 7/1975 | Senter | |
| 4,130,947 | A | 12/1978 | Denu et al. | |
| 4,274,211 | A | 6/1981 | Funck et al. | |
| 4,327,503 | A | 5/1982 | Johnson | |
| D294,655 | S | 3/1988 | Heyes | |
| 4,747,220 | A * | 5/1988 | Autry et al. | 36/59 R |

(Continued)

FOREIGN PATENT DOCUMENTS

| | | |
|---|---|---|
| DE | 33 17 462 | 10/1983 |

(Continued)

*Primary Examiner*—Marie Patterson
(74) *Attorney, Agent, or Firm*—Strategic Patents, P.C.

(57) ABSTRACT

An article of footwear having an upper and a sole is disclosed. The sole of the article of footwear includes a midsole having a support portion and a plurality of projections extending from the support portion. The sole of the article of footwear also includes a plate contacting the support portion having a body positioned in an area between the plurality of projections. The plate further includes a plurality of openings which correspond to the plurality of projections and allow the projections to extend below the body of the plate. The plate further includes a plurality of cantilever elements extending on at least one side and on the bottom of each of the plurality of projections. The projections and the corresponding cantilever elements interact with one another to form a plurality of lugs located on the sole of the article of footwear.

26 Claims, 19 Drawing Sheets

U.S. PATENT DOCUMENTS

| | | | | |
|---|---|---|---|---|
| 4,785,557 | A | 11/1988 | Kelley et al. | |
| 4,833,796 | A | 5/1989 | Flemming et al. | |
| 4,856,208 | A | 8/1989 | Zaccaro et al. | |
| 5,077,916 | A * | 1/1992 | Beneteau | 361/114 |
| 5,079,856 | A | 1/1992 | Truelsen et al. | |
| D329,536 | S | 9/1992 | Lucas | |
| 5,159,767 | A | 11/1992 | Allen | |
| 5,337,492 | A | 8/1994 | Anderie et al. | |
| 5,461,800 | A | 10/1995 | Luthi et al. | |
| 5,628,128 | A | 5/1997 | Miller et al. | |
| D385,392 | S | 10/1997 | Cass | |
| 5,713,140 | A | 2/1998 | Baggenstoss | |
| D395,339 | S | 6/1998 | Gray | |
| 5,768,806 | A | 6/1998 | Parisotto et al. | |
| 5,784,808 | A * | 7/1998 | Hockerson | 36/102 |
| 5,794,359 | A | 8/1998 | Jenkins et al. | |
| 5,806,209 | A * | 9/1998 | Crowley et al. | 36/28 |
| 5,832,636 | A | 11/1998 | Lyden et al. | |
| D404,900 | S | 2/1999 | Lupo | |
| 5,918,385 | A * | 7/1999 | Sessa | 36/59 C |
| 5,926,974 | A | 7/1999 | Friton | |
| 5,992,059 | A | 11/1999 | Bettenga et al. | |
| 6,018,889 | A | 2/2000 | Friton | |
| 6,082,024 | A | 7/2000 | Del Biondi et al. | |
| 6,119,373 | A | 9/2000 | Gebhard et al. | |
| 6,226,896 | B1 | 5/2001 | Friton | |
| D448,920 | S | 10/2001 | Montross et al. | |
| 6,354,022 | B2 | 3/2002 | Gelsomini | |
| 6,367,167 | B1 | 4/2002 | Krstic et al. | |
| 6,418,641 | B1 | 7/2002 | Schenkel et al. | |
| 6,438,870 | B2 | 8/2002 | Nasako et al. | |
| 6,438,873 | B1 | 8/2002 | Gebhard et al. | |
| D464,476 | S | 10/2002 | Wahoske | |
| 6,769,202 | B1 | 8/2004 | Luthi et al. | |
| 6,789,332 | B1 | 9/2004 | Scholz et al. | |
| 6,810,605 | B2 | 11/2004 | Nakano et al. | |
| 6,826,852 | B2 | 12/2004 | Fusco | |
| 6,862,821 | B2 | 3/2005 | Parisotto et al. | |
| 6,892,479 | B2 | 5/2005 | Auger et al. | |
| 6,964,119 | B2 * | 11/2005 | Weaver, III | 36/27 |
| 7,080,467 | B2 * | 7/2006 | Marvin et al. | 36/29 |
| 7,100,308 | B2 * | 9/2006 | Aveni | 36/27 |
| D530,493 | S | 10/2006 | Holmes | |
| 7,313,875 | B2 | 1/2008 | Morgan | |
| D564,739 | S | 3/2008 | Belley et al. | |
| D566,936 | S | 4/2008 | Schoenborn et al. | |
| D579,185 | S | 10/2008 | Mariman et al. | |
| D583,135 | S | 12/2008 | Mariman et al. | |
| 2001/0011427 | A1 | 8/2001 | Seydel et al. | |
| 2001/0027615 | A1 | 10/2001 | Nasako et al. | |
| 2002/0038522 | A1 | 4/2002 | Houser et al. | |
| 2002/0092201 | A1 | 7/2002 | Kraeuter et al. | |
| 2003/0033731 | A1 | 2/2003 | Sizemore | |
| 2003/0051372 | A1 * | 3/2003 | Lyden | 36/27 |
| 2003/0154628 | A1 | 8/2003 | Gyr | |
| 2004/0194343 | A1 | 10/2004 | Kim | |
| 2005/0081405 | A1 | 4/2005 | Healy | |
| 2005/0108897 | A1 * | 5/2005 | Aveni | 36/27 |
| 2005/0210705 | A1 | 9/2005 | Grove et al. | |
| 2005/0252038 | A1 | 11/2005 | Braunschweiler | |
| 2006/0130368 | A1 * | 6/2006 | Morgan | 36/59 R |
| 2007/0277401 | A1 * | 12/2007 | Young-Chul | 36/30 R |

FOREIGN PATENT DOCUMENTS

| | | |
|---|---|---|
| DE | 29818243 | 3/1999 |
| EP | 0352807 | 1/1990 |
| FR | 2 519 520 | 7/1983 |
| JP | 5309001 | 11/1993 |

* cited by examiner

FOOTWEAR WITH INDEPENDENT SUSPENSION AND PROTECTION

CROSS-REFERENCE TO RELATED APPLICATION

The present application claims the benefit of the filing date of U.S. Provisional Patent Application No. 60/781,126, filed Mar. 9, 2006, the entire disclosure of which is hereby incorporated by reference herein.

BACKGROUND OF THE INVENTION

The present invention relates generally to articles of footwear, and in particular to articles of footwear having an outsole having improved force distribution and stability on uneven surfaces or terrain.

Most conventional footwear is designed to deflect ground forces by using hard, rigid bottoms. This causes the wearer to absorb much of the force and impact of any uneven terrain underfoot, leading to instability, bruising and risk of injury, including for example, the turning of an ankle. Typical shoe construction, particularly with respect to athletic shoe construction such as sneakers and hiking boots, includes an upper and a sole unit. The sole unit can include multiple layers of material such as foam and/or rubber. Typically these shoes have a hard outsole to withstand abrasion and a soft midsole layer to provide absorption of ground forces. A common problem in footwear, in particular athletic footwear, is that although a softer midsole is desirable for absorption of ground forces, too soft of a midsole allows the heel to displace into the midsole under load conditions. Excessive displacement of the heel often leads to overpronation, causing instability and motion control issues. Such soles typically have a ground contacting portion in the form of an outsole with a number of traction elements thereon, which may project outwardly from the midsole portion of the shoe but, nevertheless, add only minimal force attenuation or cushioning, the bulk of which are dealt with by the midsole of the shoe. In this arrangement, when an object is stepped on or when uneven terrain is encountered, the hard outsole causes the bottom portion of the shoe to react as a unitary structure and often leads to instability when in contact with uneven surfaces. This also reduces the amount of ground contact for the shoe, which can cause traction problems. Furthermore, such a design leads to problematic levels of point loading when objects are encountered. Point loading occurs when force from an object is transferred to the foot of the wearer of the shoe such that the force is concentrated in a small area. Point loading can cause the portion of the sole with which the foot makes contact (typically an insole) to deflect upwardly into the foot, which can cause pain and discomfort for the wearer. This can also cause bruising under foot and can adversely affect whole body stability of the wearer.

Problems with stability and point loading are particularly prevalent in what is generally known as trail running. Trail running is a type of running that differs markedly from road running and track running. Road running and track running often take place on flat or smoothly inclined surfaces. In contrast, trail running generally takes place on hiking trails, most commonly on single track trails, although fire roads are not uncommon. A distinguishing characteristic of such trails is that they are often inaccessible by road except at the trail heads. The trails tend to traverse varying terrain, hills, mountains, deserts, forests, etc. Narrow traverses are common. Likewise, steep inclines or rough terrain sometimes may require hiking or "scrambling." Runners participating in trail runs must often descend these same steep grades. It is typical for trail runs to ascend and descend thousands of feet. Trail running often takes place in both organized trail races, and as a recreational activity. Common distances in races are 10 km, 20 km, 30 km, marathon (42 km), 50 km, and 50 miles. Anything over marathon distance is considered an Ultramarathon or "Ultra," which may range up to the 100 mile mark (and beyond). Trail running has become increasingly popular around the world.

With regard to footwear, trail runners have specific and unique needs as opposed to other kinds of runners such as road runners and track runners. By way of example only, road and track runners may prioritize shock attenuation and pronation control in their footwear to deal with terrain like tracks and road surfaces. Trail runners, by contrast, are often challenged to stay upright while running on unpredictable terrain. They are looking for balance of the entire body, not just pronation control. During locomotion, the foot naturally moves through various amounts of what is known in the art as pronation and supination. Such movement is described in general in the article entitled "*Standard Test Method For Comparison of Rearfoot Motion Control Properties of Running Shoes*," published by ASTM International in August, 1998, the entirety of which is incorporated by reference herein. Although unique to each individual, many people have an average maximum pronation angle of between 7 and 11 degrees during locomotion on a flat surface. Rear foot angle Θ (as shown in FIG. 31) is generally proportional to pronation angle and is typically on the order of approximately 3 degrees. The amount of pronation and/or supination experienced during trail running tends to vary among a wider range than during road or track running due to the uneven surface of the trails and the frequency with which objects are encountered underfoot, both of which influence the angle of the foot relative to the lower leg. When an object or uneven terrain causes pronation or supination to increase beyond the average maximum range for a given subject, instability begins to occur. If, for example, rear foot angle begins to approach a pronation angle of above about 20 degrees, medial motion of the knee will occur. By further example, if the rear foot angle begins to approach a pronation angle of about 30 degrees, excess motion of the hip can occur, which results in movement of the pelvis. Excess movement of the ankle, knee and hip joints may result in upper body instability. Instability contributes to loss of control or balance. In trail running, there is also a concern regarding protection from bruising under foot which may be caused by repeated impacts with rocks, roots and other irregularities with uneven terrain.

Of additional concern for trail runners is the need for moisture management, lightweight design, in-shoe security that minimizes anterior-posterior movement when running either uphill or downhill and medial-lateral movement while traversing a slope, and traction for a variety of surfaces including irregular surfaces and wet and dry terrain. Current footwear does not adequately address such trail running requirements.

It is therefore desired to provide articles of footwear that can minimize instability and that have soles which can provide the desired force attenuation and traction properties for trail running. These structures may also be beneficial for other forms of conventional running or hiking and in other situations, where objects may also be encountered and inclement conditions can cause problems relating to stability, traction and comfort. Such configurations should further provide lightweight sole designs and should be compatible with various footwear uppers.

SUMMARY OF THE INVENTION

This invention replaces a conventional midsole/outsole with an integrated support portion that has multiple independent cantilevered elements. This integrated bottom supports the foot and body during compression thereof and better distributes ground forces by adapting to uneven terrain, therefore greatly increasing stability and motion control, and acting as a return spring. The present invention relates to an article of footwear including an upper for securing a foot of a wearer and a sole. The sole includes a midsole with a support portion having a first surface coupled to the upper and a second surface. The second surface further has a plurality of projections extending therefrom in a direction away from the first surface, each projection having a side and a bottom. The sole further includes a plate having a body portion contacting the at least a portion of the second surface of the support portion and having a plurality of cantilever elements contacting at least the side and the bottom of corresponding ones of the plurality of projections. Preferably, the projections and the corresponding cantilever elements interact with one another to form a plurality of lugs located on the bottom of the article of footwear. In a preferred embodiment, the article of footwear further includes an outsole affixed to at least a portion of the lug, preferably on the cantilever element so as to form a ground-engaging surface.

In a preferred embodiment of the present invention, each of the plurality of projections extends below the support portion of the midsole at a distance of at least 5 mm. Further the projections preferably extend below the support portion of the midsole at a distance of less than about 21 mm. More preferably, the projections extend below the support portion of the midsole at a distance of about 13 mm. Further, the lugs preferably extend below the support portion of the midsole by at least 7 mm. It is also preferred that the lugs extend below the support portion of the midsole by less than 23 mm. Preferably, the lugs extend below the support portion of the midsole by about 15 mm. However, the desired distance by which the lugs extend below the support portion may vary by the location of the individual lugs on the sole of the shoe. For example, some lugs may be located near the toe region of the sole and may project at a lesser distance below the support portion than do those located near the midfoot portion of the sole. Throughout this disclosure, the distance below the support portion by which a lug (or lugs) project may be referred to as the "height" of the lug. Further, it is preferred that at least one of the plurality of lugs has a width of between 12 mm and 32 mm in the medial-lateral direction and a length of between 5 mm and 15 mm in the anterior-posterior direction. Both the length and width of the lugs in both the medial-lateral and anterior-posterior directions may vary depending on the location and orientation of the lugs within the shoe sole. Although it may be preferred to have the above-referenced height and width measurements, it is understood by those skilled in the art that measurements lesser or greater than those referenced may be applied to achieve a shoe sole as described above and is within the scope of this invention.

Preferably, the midsole is formed from a foam such as a thermoformable foam, which may be polyurethane (PU). Alternatively, the midsole may be formed from ethyl vinyl acetate (EVA), polyester or other suitable foams. The midsole is preferably made from a material having a hardness, or durometer, of about 52C on what is known in the art as an Asker C scale. In one alternative, the midsole has a hardness of at least about 45C. In another alternative, the midsole has a hardness of less than about 60 C.

Preferably, the plate is made from a plastic such as a thermoformable plastic. The thermoformable plastic is preferably a nylon and polyether blend, such as PEBAX® brand thermoplastic elastomers. Alternatively, the plate may be formed from thermoplastic polyurethane (TPU), nylon, polyether and/or polyester blends, a composite material containing carbon fiber or fiberglass, plastics such as PVC or other thermoplastic engineering materials. Desirably, the plate is made from a material having a hardness of between 50D and 70D on what is known in the art as a shore D scale, and more preferably from a material having a hardness on the order of 60D.

Preferably, the outsole is formed from a rubber material, which can include traction rubber, PU, EVA, TPU, thermoplastic rubber (TPR), or a rubberized textile material. Furthermore, the outsole may contain different materials in different areas thereof, such as the heel, toe or other ground-contacting surfaces. Optionally, portions of the outsole may have multiple layers and/or regions of the same or different materials. The material used to form the outsole may vary in hardness throughout the various sections of the outsole. Preferably, the hardness of the material used for the outsole is between 45A and 75A on what is known in the art as a Shore A scale. Variation in the hardness of the outsole material will be understood by those having reasonable skill in the art upon reading this disclosure. Preferably, the outsole has a thickness of at least about 1 mm. Further, it is preferred that the outsole has a thickness of less than 6 mm. Preferably, the thickness of outsole is about 4 mm. The cantilever elements of the present invention may include a side portion and a bottom portion. In one embodiment of the present invention, the outsole is affixed to at least the bottom portion of respective cantilever elements. In a further embodiment, the outsole is affixed to at least the bottom and side portions of respective cantilever elements. The outsole may be further affixed to the body portion of the plate. In a further embodiment, the outsole is further affixed to at least a portion of one of the plurality of projections which is exposed between the cantilever element and the body portion of the plate.

In a preferred embodiment of the present invention, at least one of the plurality of projections includes a surface which is oriented in the anterior direction. In such an arrangement it is preferable that the plate extends to cover at least a portion of this face to form a lug therebetween. Preferably such a lug is located in the forefoot region of the bottom of the article of footwear, but such a lug can be located in or near the heel region. Further, others of the plurality of projections may include a surface which is oriented in the posterior direction. The plate preferably extends to cover at least a portion of this face to form a lug therebetween. Preferably, such a lug is located toward the heel region of the bottom of the article of footwear, but such a lug may be located in the forefoot region.

It is possible to employ one or more projections in any configuration, orientation or pattern. Preferably, the midsole includes at least two projections spaced apart relative to each other in an anterior-posterior alignment. It is further preferable for midsole to include at least two projections spaced apart relative to each other in a medial-lateral arrangement. More preferably, the midsole can include at least two groups of projections spaced apart from each other in an anterior-posterior alignment. Each group of lugs preferably includes at least two projections spaced apart relative to each other in a medial-lateral arrangement. Preferably, a portion of the plate extends to cover a side portion and a bottom portion of each of the lugs used in such an arrangement. Even more preferably, the midsole can include at least three groups of projections spaced apart from each other in an anterior-posterior direction. Each group of lugs preferably includes at least three projections spaced apart relative to each other in a medial-lateral direction.

In an alternative embodiment of the present invention, at least one projection extends across substantially the entire sole in a medial-lateral direction. Preferably, the sole includes at least three of these projections. Such a projection can be either substantially straight in a medial lateral direction or can have a medial portion, a lateral portion and a middle portion, the middle portion being located toward an anterior portion of the shoe relative to the medial and lateral portions thereof.

An alternative embodiment of the present invention relates to an article of footwear including an upper and a sole. The sole includes a plate having a body portion with a plurality of spaced-apart openings, each of the openings having an edge therealong, and a plurality of cantilever elements, each of the cantilever elements corresponding to one of the openings and extending from the edge thereof below the body portion. The sole further includes a midsole having a support portion substantially contacting an upper surface of the body portion of the plate and a plurality of projections corresponding to the openings of the plate and extending therethrough, each of the projections contacting a respective one of the cantilever elements so as to form a plurality of lugs. Further, each of the plurality of lugs forms a ground contacting portion, the body portion of the plate being spaced apart from the ground contacting portions of the plurality of lugs.

A further embodiment of the present invention relates to an article of footwear having an upper and a sole. The sole includes a plate having a body with a first surface, a second surface, and a plurality of spaced apart cantilever elements extending from the first surface of the plate in a direction away from the second surface and forming a ground contacting portion spaced apart from the body of the plate. The sole further includes a midsole having a support portion with a first surface and a second surface, the first surface thereof substantially contacting an upper surface of the body of the plate.

A still further embodiment of the present invention relates to an article of footwear including an upper for securing a foot of a wearer and a sole. The sole includes a support portion having a first surface and a second surface, at least a portion of the first surface being attached to the upper. The sole further includes suspension means attached to the support portion for providing portions of the sole which engage a ground surface and which react independently to forces applied to the sole. The suspension means may include a plurality of lugs, each of the lugs having cantilever means for providing directional motion to the suspension means and cushioning means for providing support for the cantilever means. Further the cushioning means may be integrally formed with the support portion.

A further embodiment of the present invention relates to an article of footwear for use by a wearer having an upper member operable to engage a foot of the wearer and a sole connected to the upper member. The sole includes a plurality of stability members operable to engage a ground surface and to cantilever independently in response to ground forces so as to provide stability for the wearer. A first one of the plurality of stability members may cantilever in response to a first object, and a second one of the plurality of stability members may cantilever in response to a second object.

A still further embodiment of the present invention relates to an article of footwear for use by a wearer including a sole having a plurality of discreet, resilient stability members for contacting a ground surface. The stability members are operable to absorb forces and attenuate instability caused by irregularities in the ground surface. Each of the stability members may define a ground contacting portion, wherein the stability members each have a predetermined maximum depth of compression, and wherein the stability members attenuate instability by independently compressing up to the maximum depth of compression such that the ground contacting portions thereof contour to the ground surface. The stability members may reduce instability by attenuating inversion and eversion of the ankle joint of the wearer.

BRIEF DESCRIPTION OF THE DRAWINGS

The present invention will be better understood on reading the following detailed description of non-limiting embodiments thereof, and on examining the accompanying drawings, in which.

DETAILED DESCRIPTION

Figure 1:
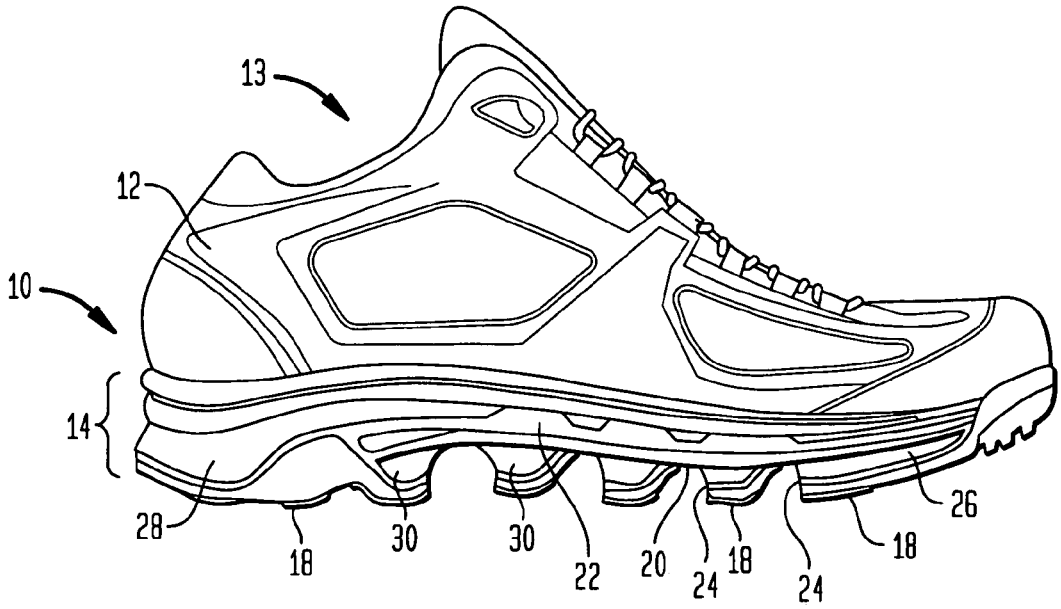
FIG. 1 is an elevation view of an article of footwear according to an embodiment of the present invention.
Figure 2:
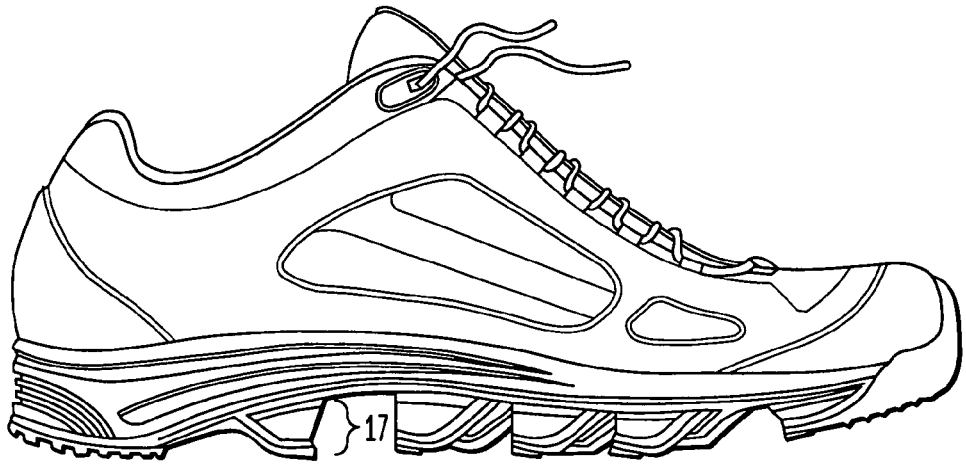
FIG. 2 is an elevation view of an article of footwear according to an embodiment of the present invention.

Referring now to the drawings, wherein like reference numerals represent like elements, there is shown in FIG. 1 an article of footwear according to an embodiment of the present invention. The particular article of footwear shown in FIG. 1 is in the form of an athletic shoe having an upper 12 and a sole 14. However, it is to be understood that the present invention could be implemented with any type of footwear, including sandals, boots, dress shoes, etc. Upper 12 is designed to receive the foot of a wearer by defining a portion of foot receiving cavity 13 therein. Upper 12 is structured to securely hold the wearer's foot and, to the extent possible, maintain the foot in contact with sole 14. Upper 12 is also preferably designed to provide support for the foot and to protect the foot from injury. Preferably, upper 12 covers the metatarsal and toe region of the foot as well as the instep portion and the heel portion of the foot.

While upper 12 may be of any configuration or style, in a preferred example upper 12 may comprise a compression molded upper having a pair of thermoformable foam layers separated by a layer of another material such as a mesh, leather, non-woven fabric, rubber, PTFE, etc. Such compression molded uppers are more fully described in co-pending U.S. patent application Ser. No. 11/362,348, filed Feb. 24, 2006, entitled "Compression Molded Footwear and Methods of Manufacture," the entire disclosure of which is hereby incorporated by reference herein.

Figure 17:
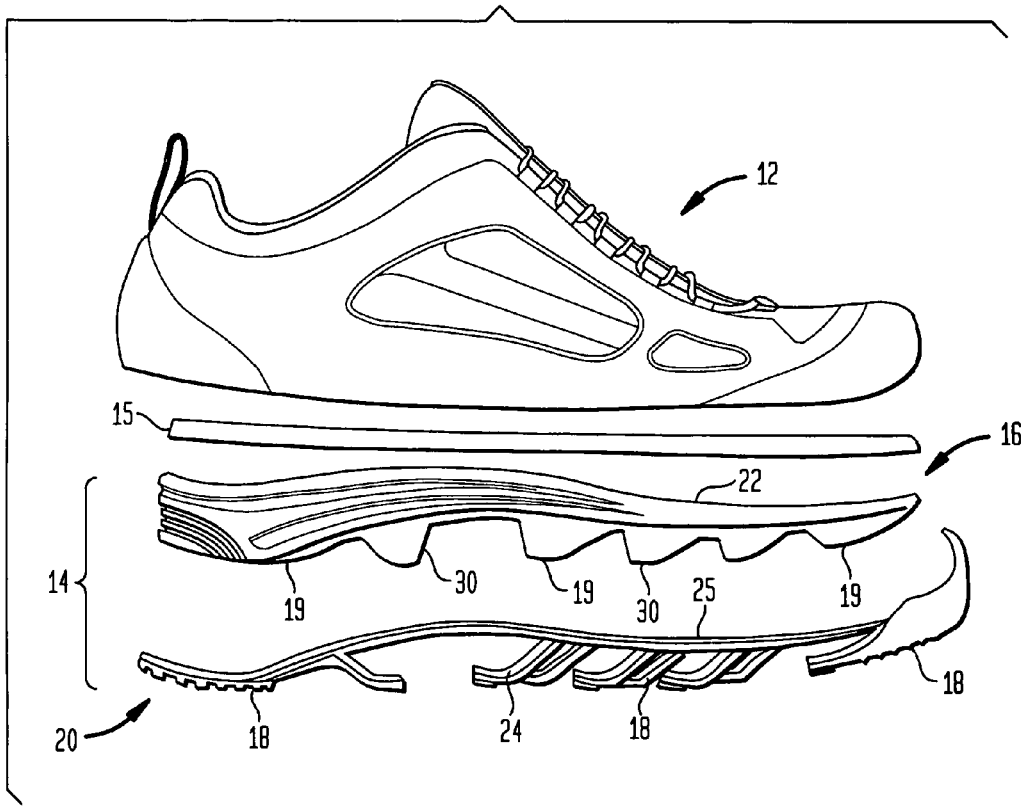
FIG. 17 is an assembly view of sole for an article of footwear according to an embodiment of the present invention.
Figure 18:
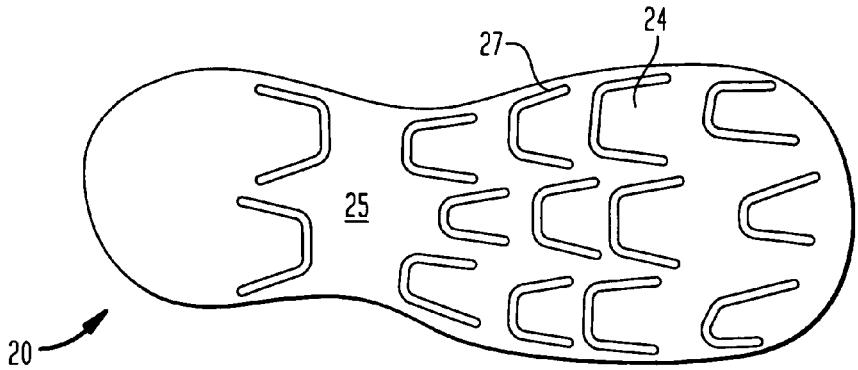
FIG. 18 is a top view of a plate for a sole for an article of footwear according to an embodiment of the present invention.

The bottom portion of foot receiving cavity 13 is defined by insole 15, which is generally structured to support and comfort the foot of the wearer of shoe 10. Sole 14 is structured to provide further support as well as protection and traction for the foot of the wearer and makes contact with the ground underneath shoe 10. Sole 14 according to an embodiment of the present invention includes midsole 16, outsole 18 and suspension plate 20. As best shown in FIG. 17, midsole 16 includes support portion 22, which contacts and substantially covers the bottom surface of the insole 15 (or the foot, if no insole is present) and provides support and cushioning for the foot of a wearer. Returning to FIG. 1, midsole 16 further includes toe section 26, heel section 28 and a plurality of spaced-apart projections 30 which extend away from support portion 22. Suspension plate 20 includes a body 25 which makes contact with and substantially covers the bottom surface of support portion 22. As best shown in FIGS. 17 and 18, suspension plate 20 desirably includes a plurality of openings 27, through which projections 30 pass and extend below body 25. Cantilever elements 24 are formed in suspension plate 20 and extend therefrom so as to mate with projections 30 to form a plurality of lugs 17 (see FIG. 1) providing additional support and cushioning for the foot of the wearer. Outsole 18 is affixed at least to the lowermost portion of lugs 17 and makes contact with the ground below the shoe 10. Outsole 18 is adapted to provide cushioning and/or traction for the wearer of shoe 10, as will be described in detail below.

Midsole 16 is generally formed from a thermoformable foam, which is preferably PU. Additional materials which can be used to form midsole 16 include EVA or other materials known in the art for such a purpose. The material from which midsole 16 is made should be selected to provide both cushioning and support for the shoe. Furthermore, the material used to form midsole 16 is desirably thermoformable so that the material can be molded into the desired shape using known molding methods. Midsole 16 can be formed, for example, either by injection molding or by compression molding, both of which are known methods for making a foam midsole. With respect to the particular midsole design of the present invention, midsole 16 can be compression molded from die-cut blockers made from PU foam or other suitable materials. In such formation, a single blocker is cut into the general shape for midsole 16, which is then compression molded into the desired shape. When such a process is used, the blocker used to make midsole 16 can be made of different types of material in different areas corresponding to specific regions of midsole 16, each possessing different characteristics such as material hardness or color. This allows different cushioning, support, force attenuation, or other properties to be used in different parts of midsole 16. Additionally, different properties for the midsole material can be selected to provide desired characteristics for the footwear depending on the weight of a wearer.

Suspension plate 20 is preferably made from a thermoformable plastic material, and more preferably from a nylon and polyether blend known as PEBAX® brand thermoplastic elastomers. Such a material is preferred due to durability, with respect to both its resistance to abrasion and with respect to its ability to repeatedly bend or flex within a range acceptable for purposes of the present disclosure without undergoing significant permanent deformation or cracking, while being generally lightweight. Alternatively, suspension plate 20 can be made from TPU, nylon, polyether or polyester blends such as HYTREL® brand polyester elastomers, composite materials containing carbon fiber or fiberglass in combination with plastics such as polyvinyl chloride ("PVC"). As shown in FIGS. 17 and 18, suspension plate 20 includes body portion 25, which is structured to mate with and substantially cover bottom surface 19 (shown in FIG. 17) of midsole 16, including the areas of support portion 22 between heel portion 28, toe portion 26 and projections 30. Additionally, support plate 20 forms cantilever elements 24 which extend along a face of lugs between the main body of support plate and the lowermost portions thereof, as well as the lowermost surfaces 19 of heel and toe portions 26, 28 and projections 30. A plurality of openings 27 in suspension plate 20 allows projections 30 to extend through body portion 25 of suspension plate 20 and into contact with corresponding cantilever elements 24 thereof.

Returning now to FIG. 1, outsole 18 may either be unitary in structure, or may be made up of separate pieces of material affixed to support plate 20 in strategic locations thereof. Further, outsole can have additional layers of material 18*a* affixed thereto to provide additional properties, such as traction, for specific areas of outsole 18. Preferably, outsole is made from what is known in the art as "traction rubber." Alternative materials for outsole 18 include PU, EVA, TPU, TPR, and rubberized textile materials, or any combinations therein. Further alternatives for outsole 18 include those known in the art for typical outsole formation. The material used for outsole should have a hardness of more than 45A, but less than 75A. Preferably, the material hardness for outsole 18 is on the order of 50A to 60A. Outsole 18 preferably covers at least the areas of sole 14 which make contact with the ground, but can cover additional portions of sole 14 and may cover the entire bottom surface of sole 14. Further, different areas of outsole 18 can be made from different materials in order to provide desired traction and/or cushioning properties to various areas of outsole 18. Preferably, outsole 18 covers the ground contacting portions of lugs 17 as well as heel 28 and toe 26 portions of sole 14. Additionally, the material for outsole 18 can cover cantilevered element 24, can extend upwardly around the toe of the shoe, and/or may cover a portion of the upper 12 in order to provide traction and protection.

Projections 30 of midsole 14 mate and interact with cantilever elements 24 of suspension plate 20 to form lugs 17. Lugs 17 are structured to react independently to the forces applied to sole 14, particularly forces from objects which may be encountered while running on a trail having irregularities in the ground surface thereof. Such irregularities of the ground surface may include uneven surfaces or terrain, as well as objects such as rocks, branches, roots, debris, etc. With a conventional sole the sole absorbs some of the force, transferring the remainder to the foot of the wearer.

Figure 30A:
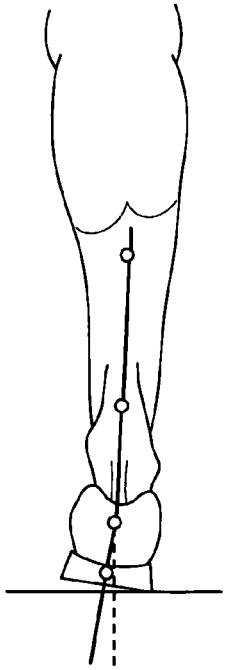
FIGS. 30(*a*)-(*c*) illustrate supination (inversion), pronation (eversion) and a neutral position of a wearer's leg and foot.
Figure 30B:
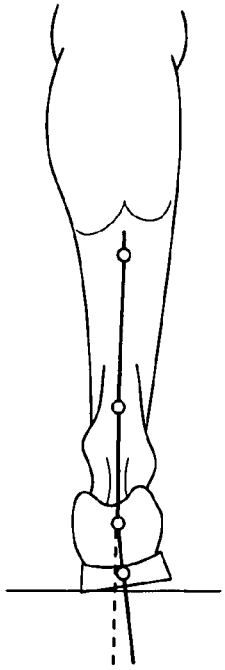
Figure 30C:
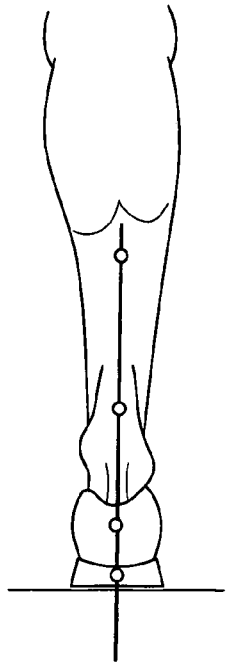

In the present embodiment the independent compression or flexion of the individual lugs 17 allows for both increased traction and stability for the footwear wearer. When traditional footwear, with an outsole formed from a single layer of rubber, encounters objects or uneven terrain, the footwear reacts as a monolithic structure, wherein the encountered ground force is only partially absorbed by deflection of the footwear sole, the remainder of the force being transferred to the foot and lower extremity of the wearer. As large ground reaction forces are caused by the footwear sole contacting an object or uneven terrain, which does not measurably compress underfoot, the force applied to the sole creates deflection of the footwear sole substantially equal to the height of either the object or other irregularity or variation in terrain. If the sole is unable to compress the required distance, then the sole is forced into uneven contact with the ground to compensate for the remaining distance. If the force is applied either medially or laterally of the centerline of the foot, the sole may be forced into an angle relative to the ground in the medial-lateral direction, as shown in FIGS. 30*a-c*. This may cause either excessive pronation (eversion) (FIG. 30*b*) or excessive supination (inversion) (FIG. 30*a*) of the foot (as compared to a neutral stance as shown in FIG. 30*c*), which may extend beyond a desirable range for a stable stance phase.

Figure 31:
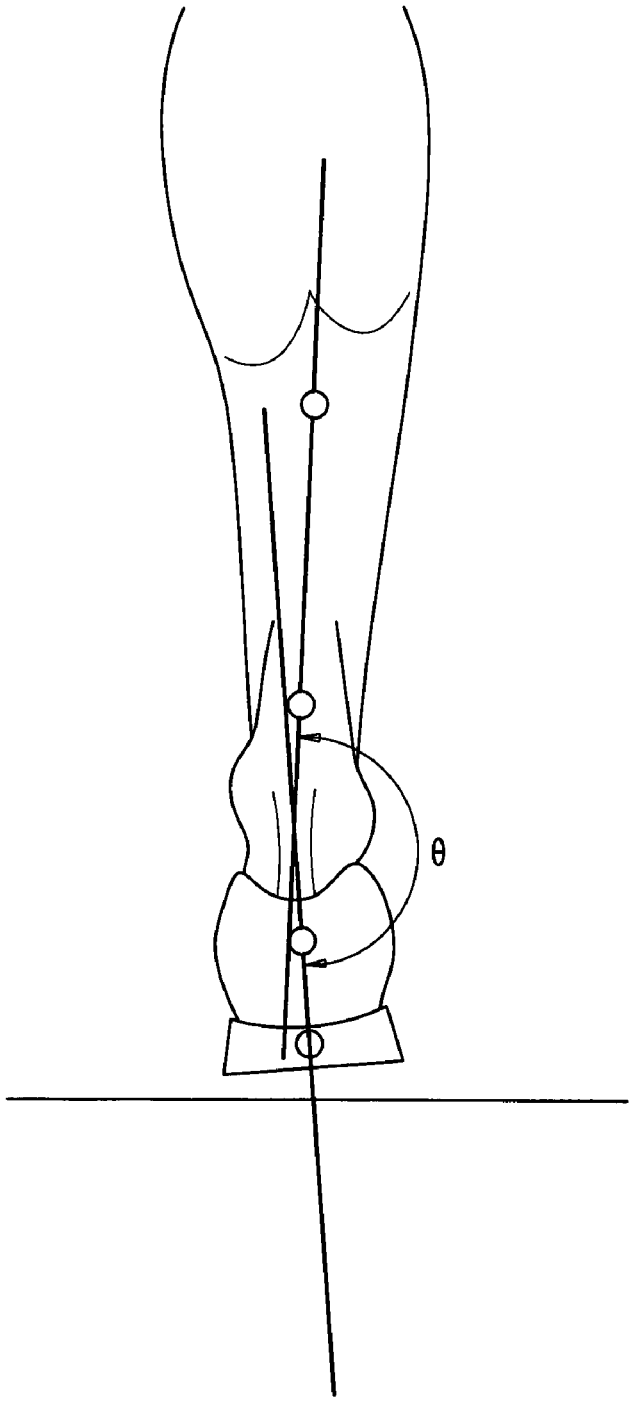
FIG. 31 is an elevation view of an exemplary lower leg, as viewed from the posterior direction.

The monolithic sole structure found in many traditional articles of footwear that are designed for running or jogging is not designed to deform by an appreciable amount in response to the impact of ground reaction forces or point loading and, therefore, can lead to instability when reacting thereto. The present embodiment of this invention, which allows for the independent deflection of the lugs 17, keeps the footwear wearer's ankle and therefore the whole body in better alignment because it is better able to maximize attenuation of reaction forces during foot strike with the independent lug and plate configuration of the bottom portion of the shoe. Ground reaction forces created by objects or uneven terrain underfoot are independently absorbed by the lugs 17, which minimizes or eliminates the transference of such forces to the wearer's foot and, therefore, the lower body. This increases stability, reduces risk of turning an ankle and reduces the transference of instability through the sole 14 and up the body to the knee, hip and upper body as compared to monolithic sole structures. Therefore, reduction of the propagation of the effects of uneven terrain keeps the foot in a more neutral position, keeps the rear foot angle Θ (FIG. 31) within a more acceptable range and, therefore, increases stability throughout the entire the body. There is also an increase in protection for the foot from excessive penetration of portions of sole 14 on uneven surfaces or point loading.

As shown in FIGS. 13*a-d*, lugs 17 allow for improved absorption of forces applied to sole 14 due to objects 100 encountered during use of shoe 10 by reacting independently to the application of such forces to prevent or reduce pronation or supination of the foot in reaction to such forces. This independent reaction to forces also helps promote better force distribution throughout the sole 14 as compared to monolithic sole structures. In particular, when one lug 17*a* contacts an object 100 which extends above the adjacent ground surface 102, that lug 17*a* compresses, while the remaining lugs 17*b*, 17*c* do not compress, or compress at a lesser distance than lug 17*a*, and, preferably, continue to make contact with the ground 102. This function of sole 14 is further illustrated in FIGS. 14*a-b*, where lug 17*h* reacts independently to the force caused by object 100, while lugs 17*g* and 171 make substantial contact with ground 102. It is to be understood, however, that the ability of the lugs 17 to maintain contact with the ground when one or more of the lugs (17*a* in FIGS. 13*a-d* and 17*h* in FIGS. 14*a-b*, for example) encounter an object is determined by the configuration of lugs 17. For example, the height of the lugs 17 may limit such an ability when the object encountered has a height that is greater than that of lugs 17. Such "bottoming out" of lugs 17, may cause other lugs 17 to loose contact with the ground. Nevertheless, the compression of lugs 17 may continue to provide for increased stability over typical footwear structures because the distance of compression of the individual lugs 17 reduces the rear foot angle Θ (FIG. 31) as compared to a typical monolithic sole structure when encountering an object of the same size. Additionally, a single object may cause multiple lugs 17 to compress at least partially, depending on, for example, the size of the object. In this case, some or all of the lugs 17 may contour to the ground surface by "giving" in response to impact with the object, which maintains substantial contact with the ground surface to further promote stability.

The design and structure of both support plate 20 and midsole 14 allow lugs 17 to effectively attenuate forces and increase stability of the shoe. Specifically, the generally compliant midsole composition allows for compression of one or more of lugs 17 depending on the nature, size, and/or shape of the compression-inducing object 100, or other ground surface irregularity, allowing lugs 17 to cushion the foot and contribute to force attenuation. With respect to support plate 20, the more rigid structure thereof provides stability for sole 14, allowing sole 14 to resist torsional movement and flexing. Further, support plate 20 gives additional support to the areas of sole 14 between lugs 17, which prevents compression of one lug 17 from causing deformation of the adjacent portions of sole 14. Still further, the structure of cantilevered elements 24 of suspension plate 20 give directional properties to lugs 17. For example, the cantilevered elements 24 are preferably positioned to cover a single side of a particular lug 17 and the ground contacting portion thereof. This allows for such a lug 17 to deflect generally upwardly in a compressive motion wherein cantilever element 24 rotates or pivots about an axis lying along the portion of suspension plate 20 where cantilevered element 24 meets body 25 of plate 20. In such an arrangement, projection 30 compresses to accommodate and support the rotation or pivoting of cantilevered element 24. Preferably cantilever elements 24 of lugs 17 located on the forefoot section of sole 14 extend on the anterior surface of projections 30, and cantilever elements 24 of lugs 17 located on heel portion 28 of sole 14 are positioned on the anterior surface of projections 30. This arrangement for the directional orientation of lugs 17 creates a spring effect which aids in propulsion, braking, and stability.

Furthermore, as shown in FIG. 17, cantilevered elements include two angles, namely angles $\beta$ and $\phi$. The values for angles $\beta$ and $\phi$ should be selected to provide appropriate height and anterior-posterior width characteristics for lugs 17, as well as to properly align the ground-contacting portions thereof. Additionally, angles $\beta$ and $\phi$ should be selected so as to appropriately contribute to the directional properties of lugs 17 discussed above. For example, while both angles may be about 90°, such an arrangement would tend to favor vertical compression of lugs 17 as opposed to rotation of cantilevered element 24, which is preferred. Thus, angle $\beta$ is desirably an obtuse angle and angle $\phi$ is desirably an acute angle. In one embodiment angle $\beta$ is at least about 110°. In another embodiment angle $\beta$ is no greater than about 150°. Preferably, angle $\beta$ is about 135°, for instance between about 125° and 145°, more preferably between about 130° and 140°. In a further embodiment angle $\phi$ is at least about 20°. In an alternative embodiment angle $\phi$ is no more than about 60°. Preferably, angle $\phi$ is about 45°, for instance between about 35° and 55°, more preferably between about 40° and 50°. In one example, the angles are selected so that the bottom of the lug 17 is substantially parallel to the ground or other terrain during normal use conditions. Of course, it should be understood that these angles are merely exemplary and may vary above or below these ranges. It is also possible for different lugs 17 to have different angles $\beta$ and/or $\phi$, for instance depending upon the size, shape, placement, and/or orientation of a given lug 17.

As discussed above, the structure of suspension plate 20 may include openings 27 above the portions of suspension plate 20 where cantilever elements 24 project downwardly from body portion 25. The openings 27 provide additional force attenuation by allowing absorption of force applied to lug 17 not only in projection 30, but also in the adjacent area of support portion 22. Further, the incorporation of opening 27 into the structure of suspension plate 20 allows lugs 17 to be designed such that cantilever element 24 can be forced upward through opening 27, for instance during extreme impact conditions for increased stability and force attenuation.

Sole 14 may be structured so as to provide lugs 17 having varying hardness among the different areas of sole 14. For example, lugs 17 located near the perimeter of sole 14 can have a greater hardness than those located near the center of sole 14. Such an arrangement provides stability around the perimeter of sole 14, while providing increased compression toward the center of sole 14. Also, different lugs may have cantilevered elements 24 with different properties, for instance different materials, thickness, orientation, spacing, depth, etc. Additionally, lugs 17 can be formed of cantilever elements 24, without having mating projections 30 formed in midsole 16. Such a structure for lugs 17 can be used alone or in combination with lugs 17 having cantilever elements 24 and mating projections 30 formed in midsole 16 to provide desired stability and force attenuation characteristics in various areas of sole 14. In an alternative embodiment of the present invention, cantilever elements 24 can be formed of alternative materials such as carbon fiber or spring steel, which can be attached to a main body 25 for suspension plate 20 that is made of the materials discussed above. Cantilever elements 24 made of such materials may have a hardness adequate to form lug 17 from cantilever element 24 having no mating projection 30 formed in midsole 16 (as shown in FIGS. 26-29), or having mating projections 30 of a composition different than the mating projections 30 of other lugs 17.

The hardness of lugs 17 can also be made so as to correspond to various weights of various wearers of the footwear. For example, a greater weight of the wearer will cause greater ground forces to be applied underfoot due to objects or uneven terrain. This can lead to diminished effectiveness of lugs with respect to both stability and blunt force attenuation and can increase the likelihood of bottoming out of lugs 17 during use. Accordingly, lugs 17 may be structured so as to have a hardness that is greater in similar footwear designed to be worn by a more lightweight wearer. This increased hardness can counteract the increased ground forces caused by the weight of the wearer. Conversely, a wearer with a lower weight can reduce ground forces underfoot to a point where the ground forces are no longer adequate to cause operative movement of the individual lugs 17. This condition may be remedied by reducing the hardness of lugs 17, thereby reducing the amount of ground force necessary to cause deflection of lugs 17. In one embodiment, an article of footwear of the present invention can be designed to provide a desired hardness for lugs 17 so as to correspond with a predetermined weight range for the wearer thereof. In this embodiment of the present invention, the hardness of lugs 17 can be varied by using different materials for midsole 16 or for cantilever elements 24, as well as by varying the size and/or shape of projections 30 or cantilevered elements 24. As different wearers of a shoe of the same size may be of varying weights, footwear according to the present invention may be provided that differ in both hardness levels, as well as size, for lugs 17 throughout ranges which would be reasonably understood by one having skill in the art.

Figure 13A:
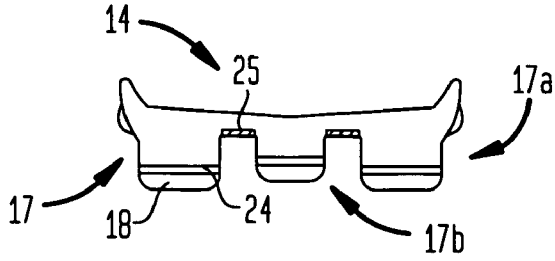
FIGS. 13*a-d* are cross-section views of a sole for an article of footwear according to an embodiment of the present invention.
Figure 13B:
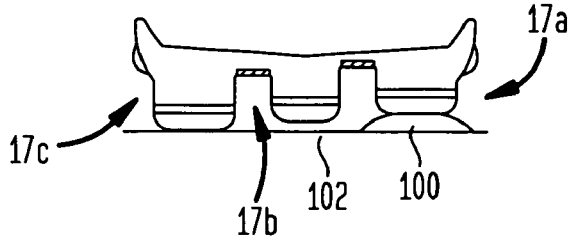
Figure 13C:
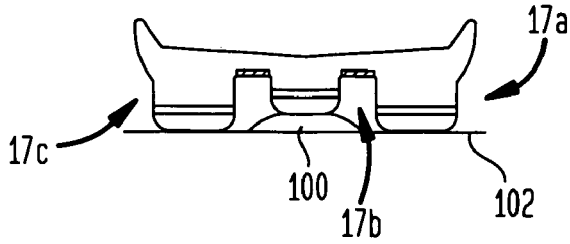
Figure 13D:
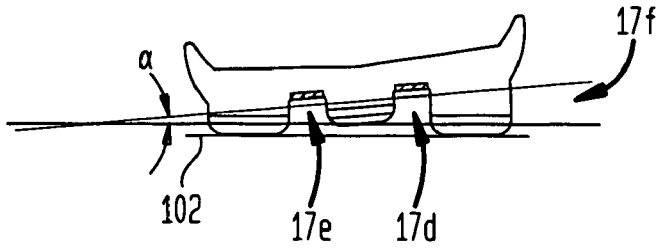
Figure 14A:
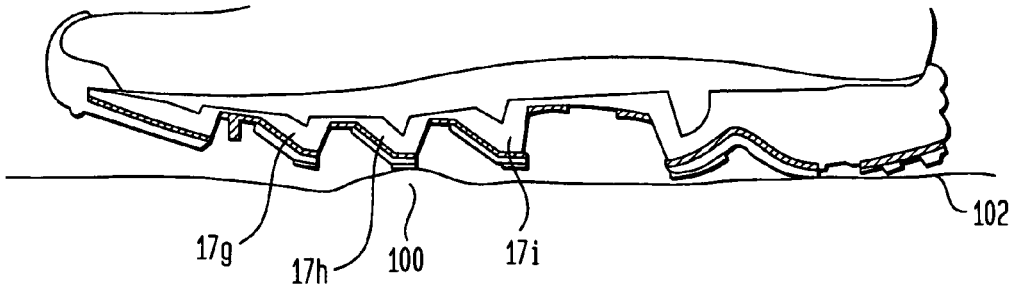
FIGS. 14*a-b* are cross-section views of a sole for an article of footwear according to an embodiment of the present invention.
Figure 14B:
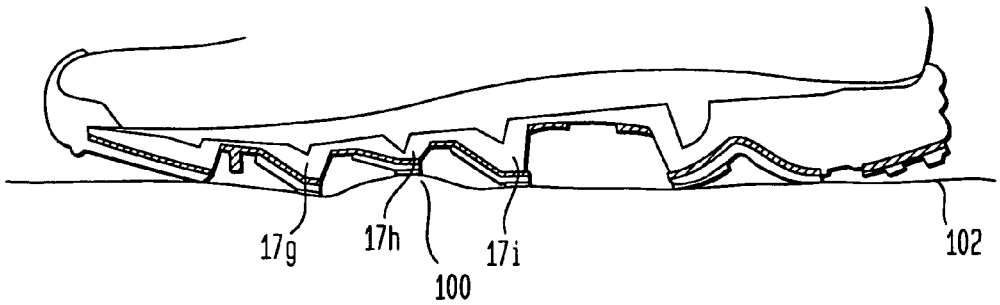
Figure 15:
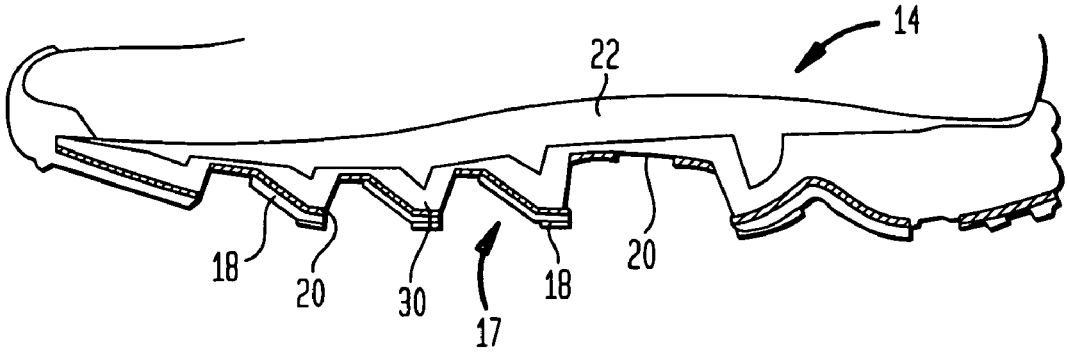
FIG. 15 is a cross-section view of a sole for an article of footwear according to an embodiment of the present invention.

Additionally, the structure of lugs 17 improves ground contact for sole 14 when the shoe makes contact unevenly with the ground, particularly when cornering or cutting. As shown in FIG. 13*d*, when shoe 10 contacts the ground unevenly, such as at angle $\alpha$ in FIG. 13*d*, some or all of the individual lugs 17 may compress so that substantially all lugs 17 make contact with the ground surface 102. This improves traction, which is particularly useful in such situations, as well as even support for the foot, reducing the angle formed between the foot and lower leg, which reduces problematic over-pronation or over-supination of the foot compared to traditional footwear, and thus reduces ligament stress at the ankle and enhances stability for the whole body.

Figure 4:
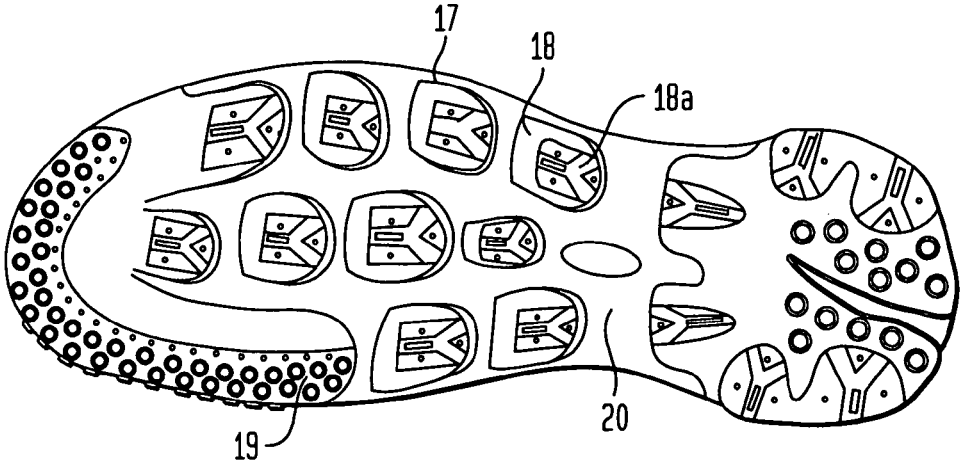
FIG. 4 is a bottom view of an article of footwear according to an embodiment of the present invention.
Figure 5:
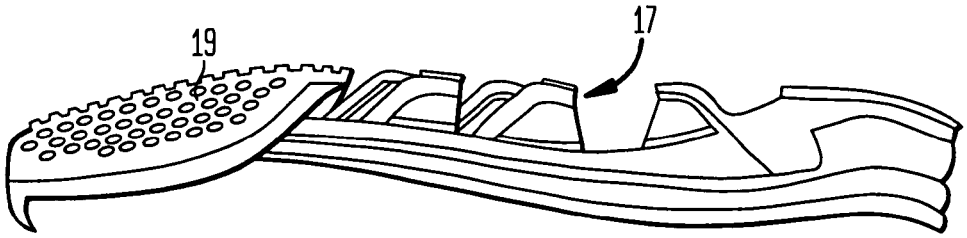
FIG. 5 is an elevation view of a sole for an article of footwear according to an embodiment of the present invention.

Sole 14 can include any number of lugs 17, but preferably includes more than one lug 17. In one preferred example, sole 14 preferably includes fewer than twenty lugs 17 and more preferably includes about fourteen lugs 17. In another preferred example, sole 14 includes two lugs 17 in the heel region thereof, which extend toward the forefoot portion and are formed so as to extend from heel portion 28. Similarly, the toe region of sole 14 preferably includes three lugs 17 which extend from toe portion 26 in a generally posterior direction. In this example, sole 14 preferably includes nine independent lugs located in the forefoot region. These lugs 17 are preferably arranged in three rows of three lugs each. The lugs are preferably between 5 mm and 15 mm long in the anterior-posterior direction and are preferably between 12 mm and 32 mm long in the medial-lateral direction. Lugs 17 may be evenly distributed throughout the forefoot portion of sole 14 in both the medial and lateral directions. In one example, lugs 17 have a height of at least 2 mm. In another example, lugs 17 have a height of no more than 10 mm. In a further example lugs 17 preferably have a height of between 7 mm and 23 mm and, more preferably, about 15 mm. Lugs 17 may be oriented in a generally grid-like pattern, or may be in a staggered or other arrangement relative to each other. While the size, spacing, orientation and arrangement of the lugs 17 may vary depending upon the type of shoe, environmental conditions, fashion, etc., it is desired that different lugs 17 be able to function, e.g. operate in a cantilever manner independently from one another. In a further preferred example, a single lug 17 having multiple zones which act generally independently from one another is included in heel 28 and toe 26 portions of sole 14. Such generally independent movement can be provided by separating the zones into distinct portions (as shown in FIG. 4). In one example of such an arrangement, a particular lug 17 may have a first zone which when subjected to force from an object will deflect to absorb such force, and the lug may have a second zone which, by virtue of being a part of the same lug, may deflect in response to the force, but by somewhat less than the first zone.

Figure 3:
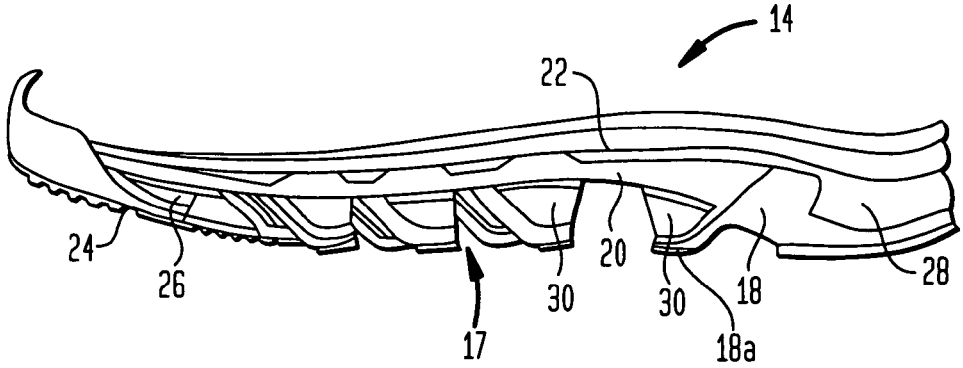
FIG. 3 is an elevation view of a sole for an article of footwear according to an embodiment of the present invention.
Figure 19:
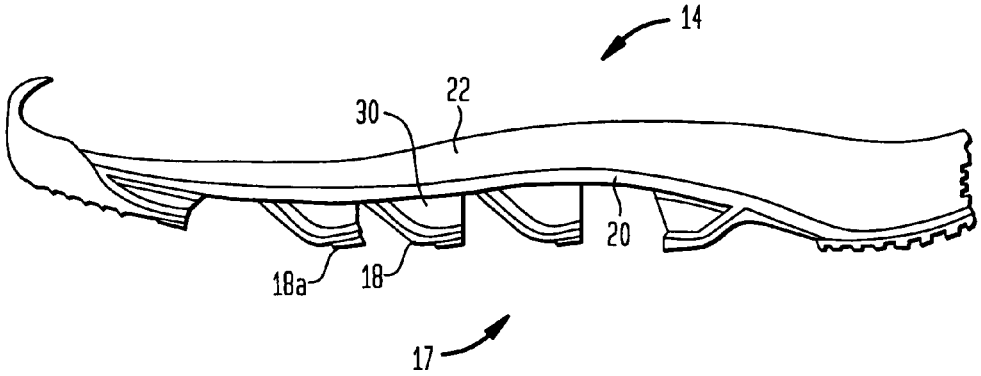
FIG. 19 is an elevation view of a sole for an article of footwear according to an embodiment of the present invention.
Figure 20:
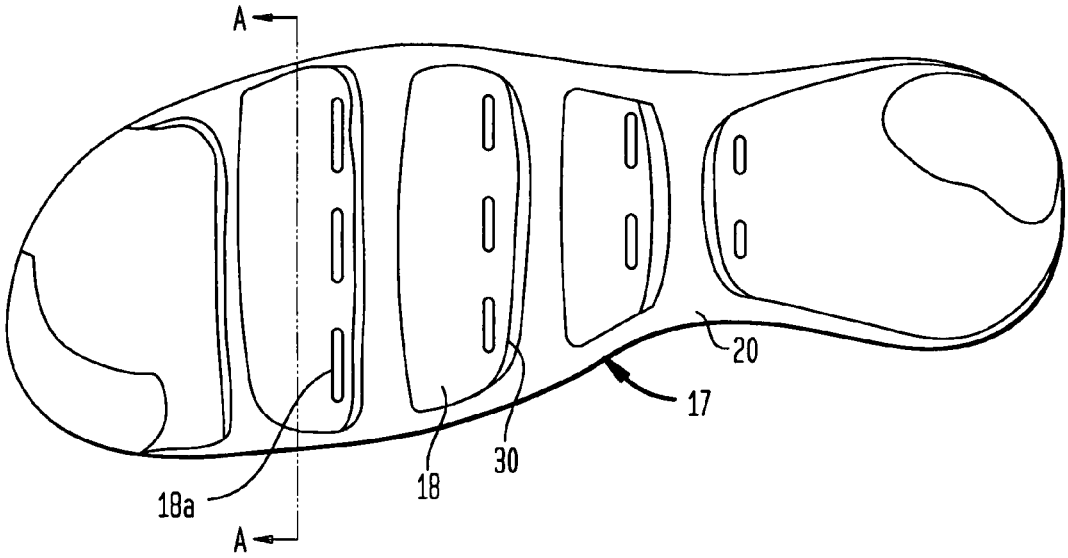
FIG. 20 is a bottom view of a sole for an article of footwear according to an embodiment of the present invention.
Figure 21:
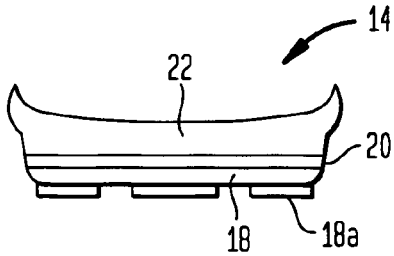
FIG. 21 is a cross-section view of a sole for an article of footwear according to an embodiment of the present invention.
Figure 22:
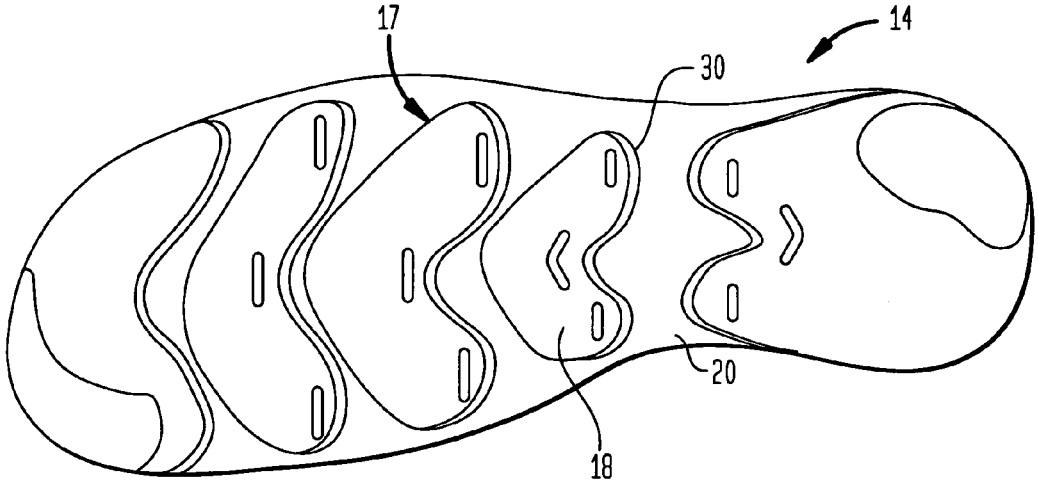
FIG. 22 is a bottom view of a sole for an article of footwear according to an embodiment of the present invention.

Further arrangements for lugs 17 are contemplated, and can include elongated outer toe lugs 19, as shown in FIGS. 3 and 4. Additionally, lugs 17 can extend across the entire sole in the medial-lateral direction, as shown in FIGS. 19-21. A further variation of lugs 17 shown in FIG. 22 extends across sole in the medial-lateral direction in a zig-zag or "V"-shape. Further, various combinations of the aforementioned lug 17 shapes and arrangements are possible. Such variations are designed to provide the desired force attenuation and stability properties to various areas of sole 14 as would be understood by one having reasonable skill in the art upon reading this disclosure. Specifically, multiple lug configurations can be used and can be combined with a variety of traction elements in order to provide desirable traction for a range of surfaces and conditions. For example, a heel of the type typically found on athletic footwear can be used in combination with lugs or spring elements located in the forefoot region of the shoe.

Figure 6:
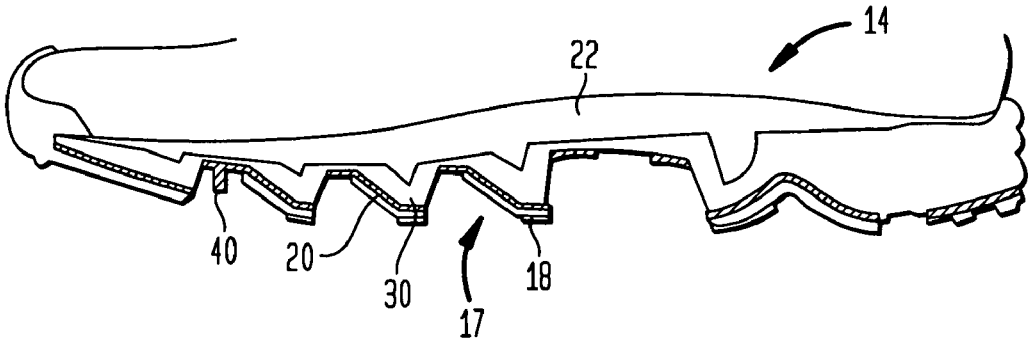
FIG. 6 is a cross-section view of a sole for an article of footwear according to an embodiment of the present invention.
Figure 7:
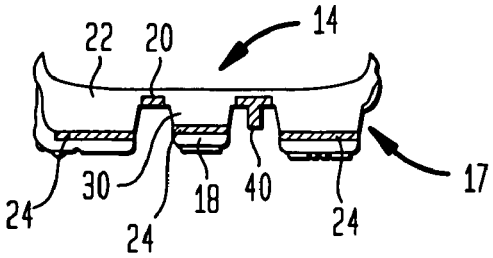
FIG. 7 is a cross-section view of a sole for an article of footwear according to an embodiment of the present invention.
Figure 8:
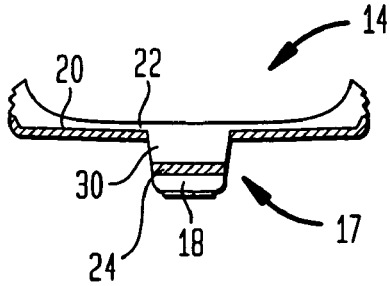
FIG. 8 is a cross-section view of a sole for an article of footwear according to an embodiment of the present invention.
Figure 9:
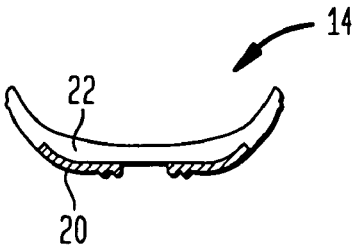
FIG. 9 is a cross-section view of a sole for an article of footwear according to an embodiment of the present invention.
Figure 10:
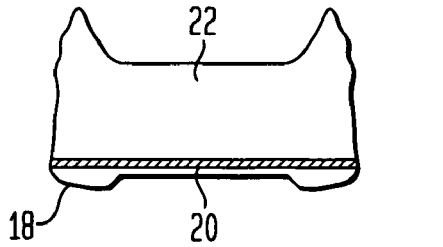
FIG. 10 is a cross-section view of a sole for an article of footwear according to an embodiment of the present invention.
Figure 11:
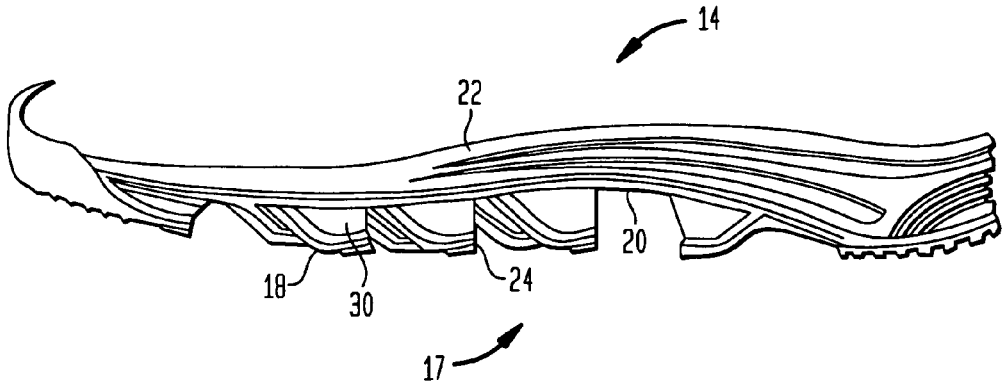
FIG. 11 is an elevation view of a sole for an article of footwear according to an embodiment of the present invention.
Figure 12:
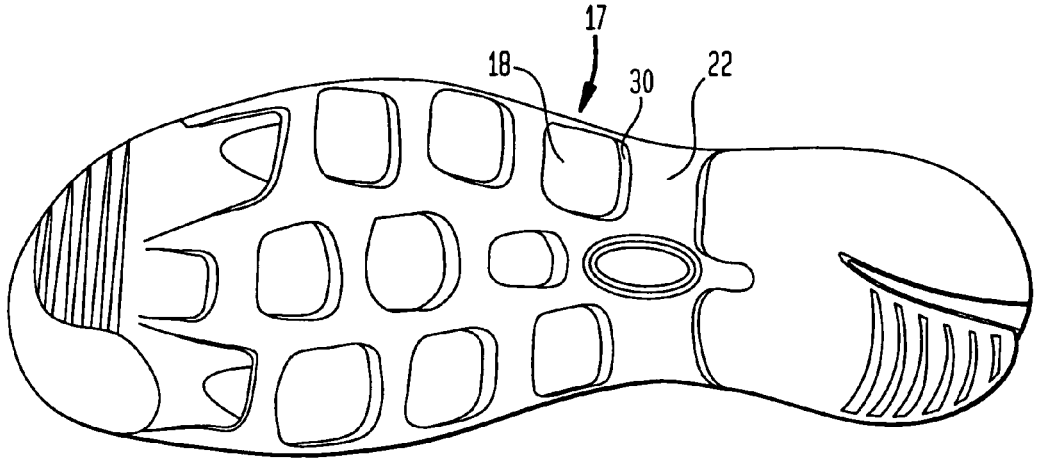
FIG. 12 is a bottom view of an article of footwear according to an embodiment of the present invention.
Figure 16:
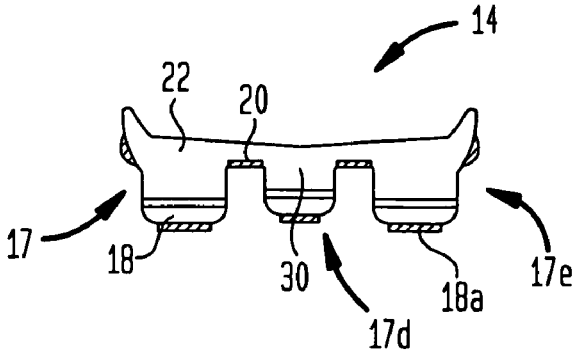
FIG. 16 is a cross-section view of a sole for an article of footwear according to an embodiment of the present invention.

Additionally, lugs 17 can vary in height within the design of sole 14. Specifically, it may be desired to have specific lugs 17 that are shorter than adjacent lugs 17. For instance, some of the lugs may have a height of about 15 mm and other lugs may have heights between about 2 and 10 mm. As shown in FIG. 16, middle lug 17*d* can be shorter than outside lugs 17*e*, 17*f*. In such an arrangement, middle lug 17*d* may have a height that is between 0 and 10 mm less than the heights of outside lugs 17*e*, 17*f*. In such an arrangement, outside lugs 17*e*, 17*f* contact the ground before middle lug 17*d*. Such arrangements can be useful for cushioning or for foot-strike control, such as pronation control. Additionally, lugs 17 may be shorter, for example in the toe region, as compared to the forefoot region as this enables the shoe to provide a smoother gait from heel strike to toe-off. Further, the structure of cantilever element 24 is such that it prevents lugs 17 from bending or flexing in the medial-lateral direction, which makes the shoe more stable, particularly when cornering. Furthermore, additional traction elements 40 (shown in FIGS. 6 and 7) preferably having a height shorter than at least one of lugs 17 may be included in the outsole 18 of the shoe. Such additional traction elements 40 may be in the form of protrusions, including spikes. Such protrusions may be resilient and be made from rubber or another suitable outsole material, or may be rigid and be made from plastic, metal or other such material. These additional traction elements 40 may be of a sufficient height such that they engage the ground surface when lugs 17 deflect in response to uneven terrain or the like.

Figure 24:
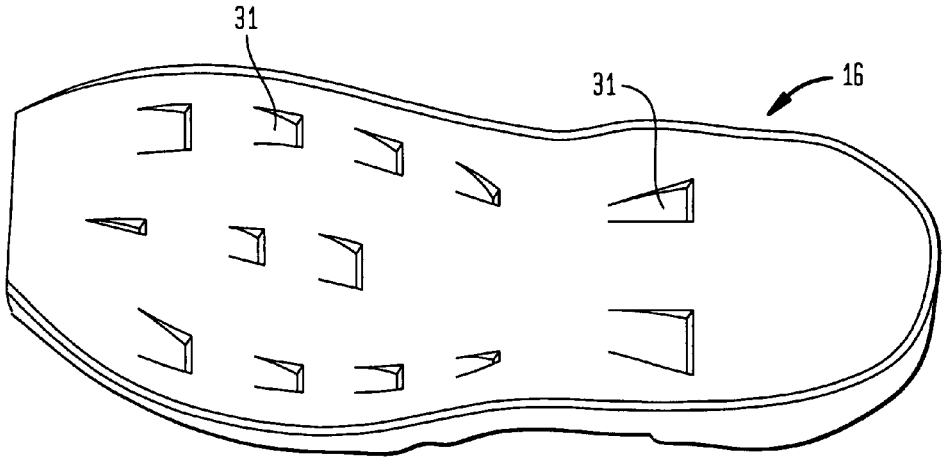
FIG. 24 is a top view of a midsole for an article of footwear according to an embodiment of the present invention.
Figure 25:
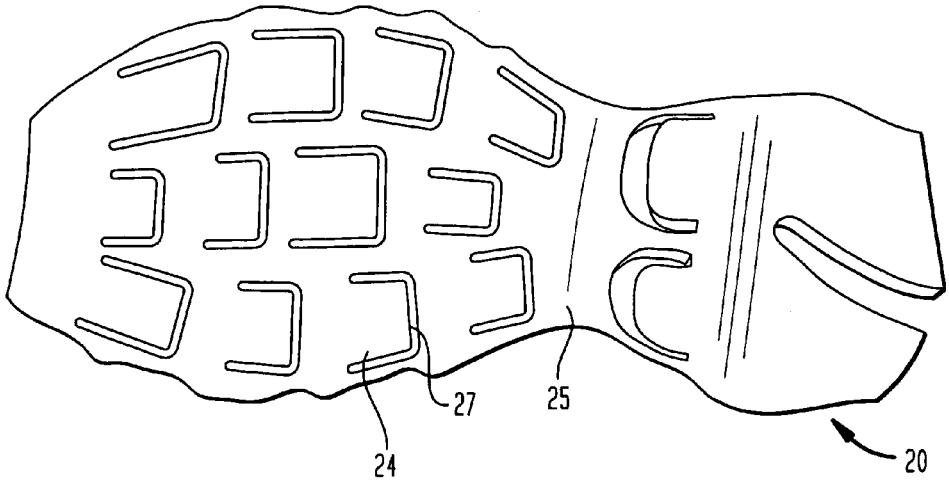
FIG. 25 is a bottom view of a suspension plate for an article of footwear according to an embodiment of the present invention.

As shown in FIG. 24, projections 30 can be formed with hollow inside recesses 31 therein. Recesses 31 preferably extend from the upper surface of support portion 22 and into at least a portion of the interior of projection 30. This not only aids in formation of projections 30, but can also be used to vary the hardness or compressibility of lugs 17. For example, a larger recess 31 will increase the compressibility of the corresponding lug 17. Further, the shape of recesses 31 can vary within the corresponding projection 31 in order to control the compression of corresponding lugs 17. For example, recesses 31 of varying sizes can be incorporated into lugs 17 to provide different levels of compressibility from lugs formed from the same material. In an example of such an embodiment, lugs 17 in or near the toe 26 or heel 28 regions of sole 14 may be more or less compressible than lugs in the remainder of sole 14. In one variation of this example, lugs 17 in heel region 28 may be more compressible than the remaining lugs 17, particularly those in the toe region 26. This can be done in order to provide additional foot strike cushioning for runners who make initial contact with the ground with their heel. In another example of this embodiment, lugs 17 on the medial side of sole 17 may be more or less compressible than lugs 17 on the lateral side of sole 14. In one variation of this example, lugs 17 on the medial side of sole 14 are less compressible than lugs 17 on the lateral side of sole 14. This variation may be used, for example, to control pronation of the foot during running. Further variations of the foregoing examples are possible, and may include various combinations thereof. As discussed above, it may be desirable to vary the hardness of lugs 17 to accommodate for varying weights of wearers of footwear. This variation can be further accomplished by varying the size of the recess 31 within lugs 17.

Figure 23:
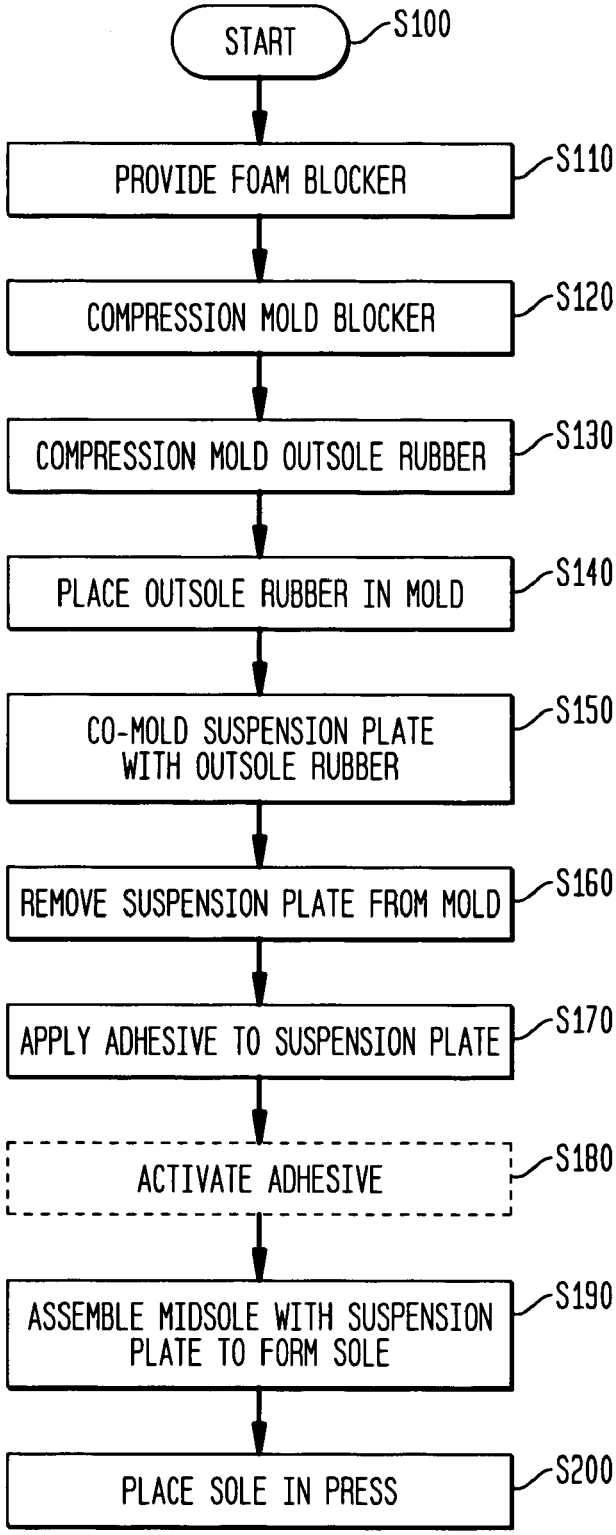
FIG. 23 is a flowchart showing a process of making a sole for an article of footwear according to an embodiment of the present invention.

Referring now to FIG. 23 a process for making sole 14 according to an embodiment of the present invention is shown with optional steps indicated by a broken line. In this process sole 14 according to an embodiment of the present invention is preferably formed by providing a die-cut EVA foam blocker in step S110. The general design and structure of blockers are generally known in the art. The blocker is then compression molded in step S120 into the desired shape, as discussed with reference to the various figures herein. Outsole 18 is then compression molded in step S130 (which can be completed contemporaneously with the compression molding of midsole) from stock rubber. As discussed above, this can be done so as to form individual sections of outsole 18, which correspond to specific areas of sole 14 or so as to form an outsole 18 that substantially covers the entire bottom surface of sole 14. Suspension plate 20 is then co-molded with outsole 18 in step S150 (which can also be completed contemporaneously with the compression molding of midsole). In such a co-molding process, outsole 18 is inserted into appropriate cavities in a mold at step S140, and then suspension plate 20 is formed within the mold by injection molding.

Once the combination suspension plate and outsole has cooled, it is removed from the mold in step S160 and attached to midsole 16 using an adhesive. Preferably, such an adhesive is heat-activated, and is applied to suspension plate 20 and allowed to dry in step S170. The adhesive is then heated so that it becomes activated in step S180. Midsole 16 is then assembled with suspension plate 20 and then placed in a press in step S200 to ensure proper adhesion of the parts to form sole 14.

Alternative processes for forming sole 14 according to an embodiment of the present invention include injection molding midsole 16 with projections 30 formed therein. If midsole 16 is formed by injection molding, it can nonetheless be compression molded thereafter to add additional shape or features as would be reasonably understood in the art. A further alternative includes open pouring midsole 16 using PU. Both of the aforementioned variations of midsole 16 may then be subjected to the remaining process steps in order to form sole 14.

Figure 26:
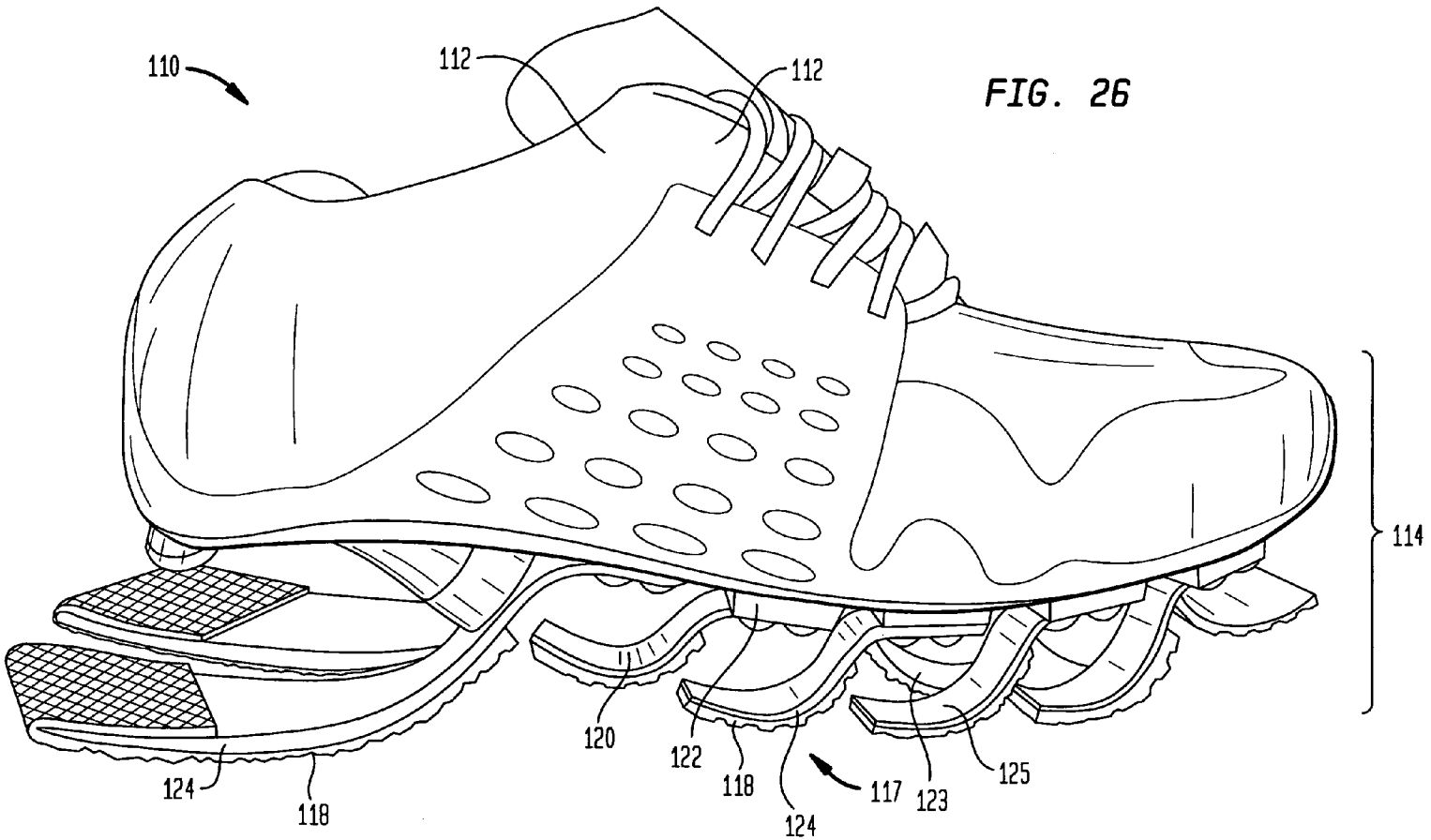
FIG. 26 is an elevation view of an article of footwear according to an embodiment of the present invention.
Figure 27:
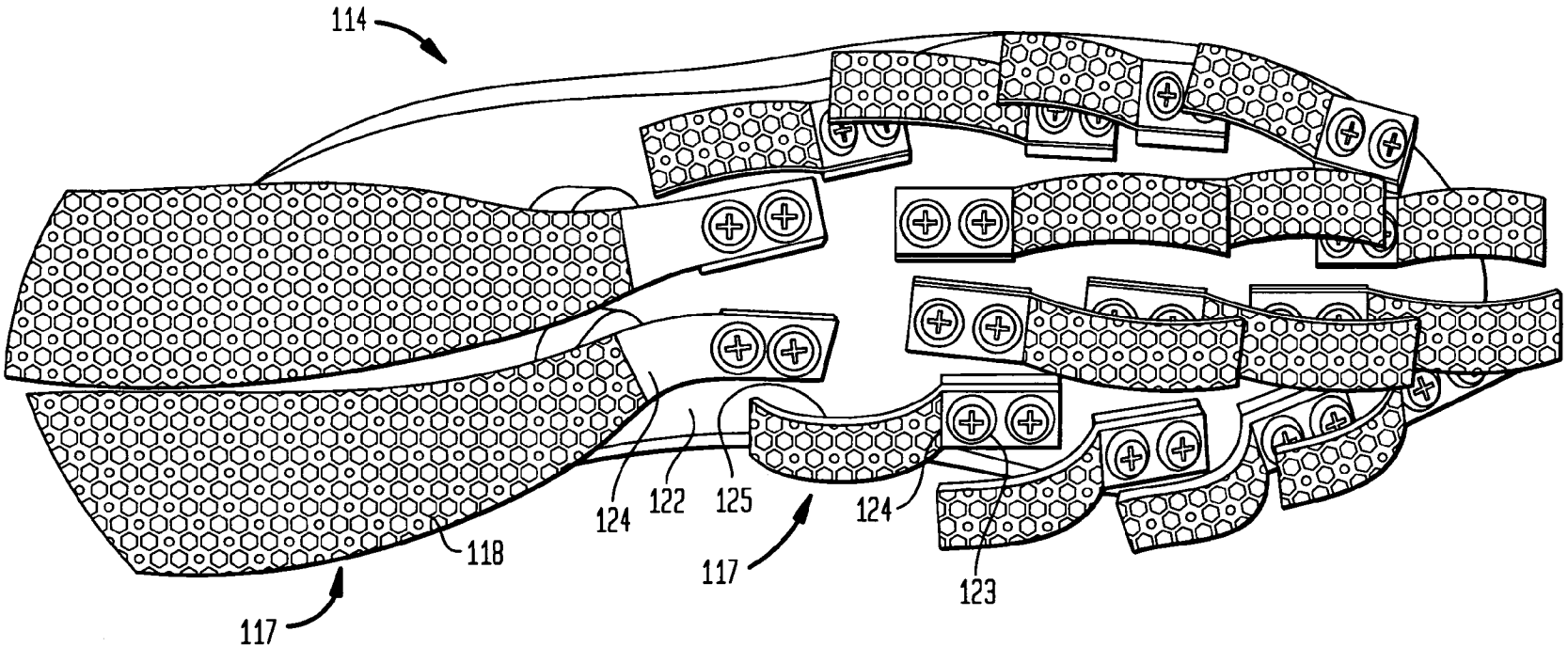
FIG. 27 is a bottom view of an article of footwear according to an embodiment of the present invention.

Alternatively, as illustrated in FIGS. 26-29, lugs 117, 217 may be formed by spring element 124, 224 affixed to suspension plate 120, 220 and further having a portion of outsole 118, 218 affixed thereto. As shown in FIGS. 26 and 27, spring elements 124 may be formed separately from body 122 of suspension plate 120, and may include attachment portion 123, and spring portion 125. In the current embodiment, spring portion 125 projects away from attachment portion 123. In this arrangement for lugs 117, spring elements 124 may be formed from a material that is more rigid than body 122. This is useful because it compensates for the support of lug 117 which, in alternative embodiments of the present invention, is provided by projections 17 (an example of which is shown in FIG. 1). Suitable materials for spring elements 124 include carbon fiber composite and spring steel. Further, spring element 124 of the type shown in FIGS. 26 and 27 could be integrally formed with body 122.

Figure 28:
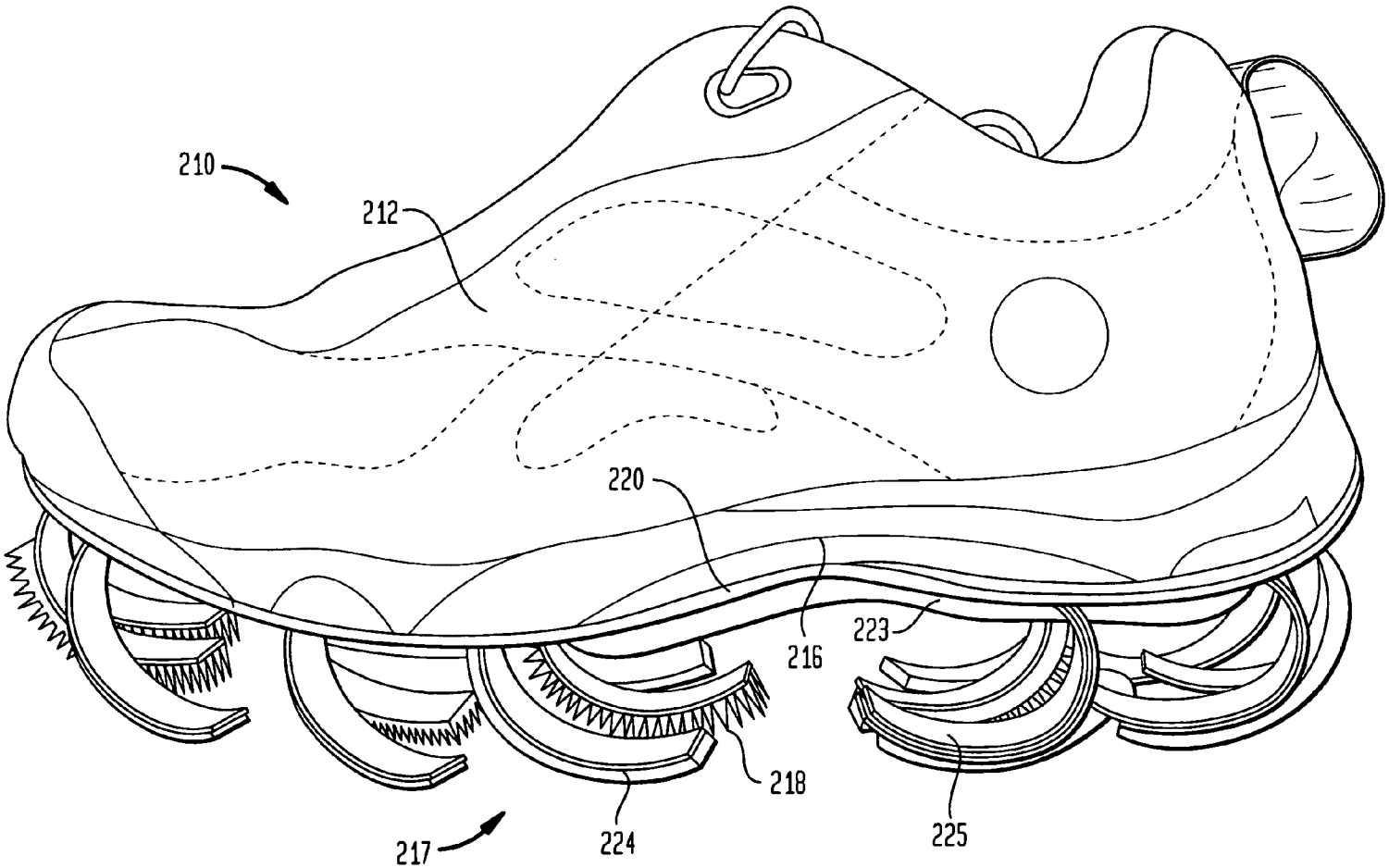
FIG. 28 is an elevation view of an article of footwear according to an embodiment of the present invention.
Figure 29:
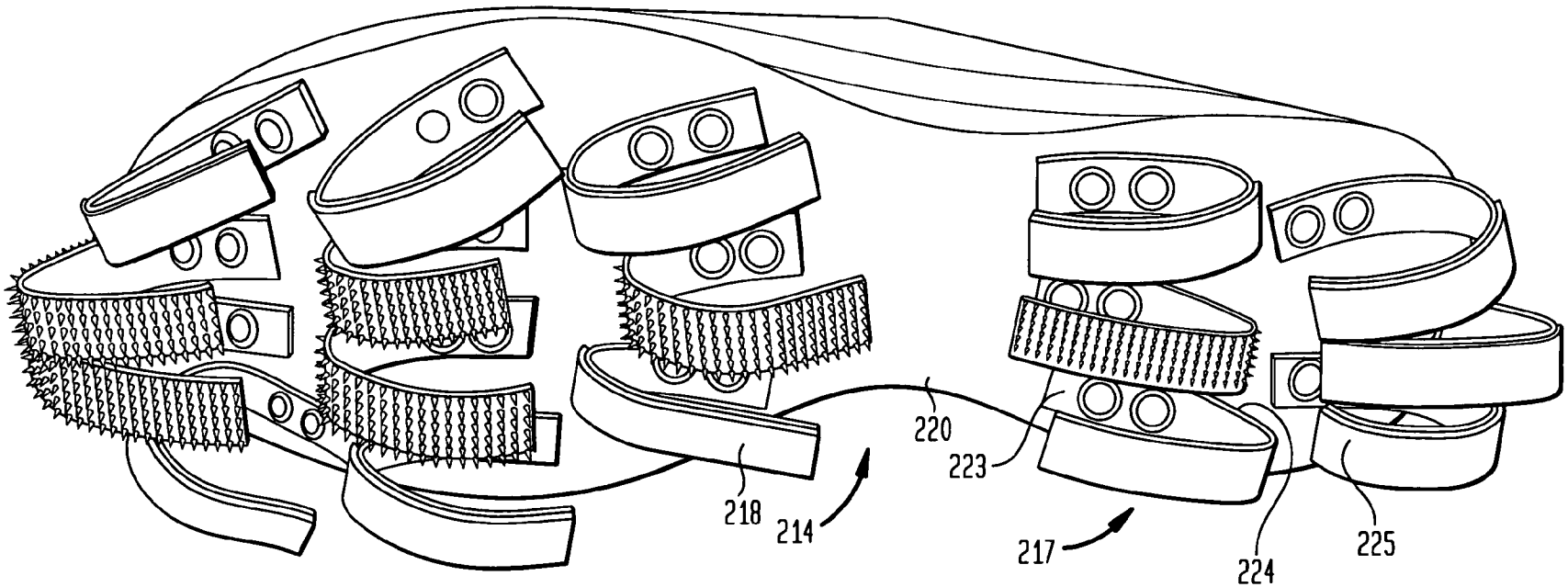
FIG. 29 is a bottom view of an article of footwear according to an embodiment of the present invention.

An alternative embodiment of a shoe 210 having lugs 217 formed from spring elements 224 is shown in FIGS. 28 and 29. In this particular embodiment, spring element 224 is formed separately from body 222 of plate 220 and includes attachment portion 223 and spring portion 225. In this embodiment spring portion 225 extends generally in the same direction as attachment portion 223. Further, spring portion 225 may have a portion thereof which extends at least partially under attachment portion 225. As with respect to the embodiments discussed with reference to FIGS. 26 and 26, it may be desirable to form spring elements 224 of a more rigid material than body 222.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An article of footwear, comprising:

an upper for securing the foot of a wearer; and a sole including:

a midsole having a support portion having a first surface and a second surface, the first surface being coupled to the upper and the second surface having a plurality of projections extending therefrom in a direction away from the first surface, each projection having a side and a bottom; and a plate having a body portion contacting at least a portion of the second surface of the support portion and having a plurality of cantilever elements contacting at least the side and the bottom of corresponding ones of the plurality of projections.

2. The article of claim 1, wherein the body portion of the plate has a plurality of spaced-apart openings, each of the openings having an edge therealong, said cantilever elements extend from corresponding ones of said edges, and wherein said projections extend through corresponding ones of said openings.

3. The article of claim 1, wherein the plate comprises a thermoformable plastic.

4. The article of claim 3, wherein the thermoformable plastic has a hardness of between 50D and 70D.

5. The article of claim 1, wherein the midsole comprises a thermoformable foam.

6. The article of claim 5, wherein the thermoformable foam is an EVA foam or a polyurethane foam.

7. The article of claim 1, wherein the plurality of projections and corresponding ones of the plurality of cantilever elements interact with each other to form a plurality of lugs for engaging ground surfaces.

8. The article of claim 7, wherein each one of said plurality of lugs compresses generally independently of one another to a force applied thereto.

9. The article of claim 7, wherein a first one of said plurality of lugs has a first compressibility thereof and a second one of said plurality of lugs has a second compressibility thereof, said first compressibility being greater than said second compressibility.

10. The article of claim 8, wherein a first one of the lugs has a first height, and a second one of the lugs has a second height.

11. The article of claim 7, wherein the sole has a midfoot region, a toe region and a heel region, and wherein a first one of the plurality of lugs is disposed in one of the midfoot region, heel region or toe region.

12. The article of claim 11, wherein the side of a selected one of the plurality of projections faces in an anterior direction and is disposed in either the midfoot region or toe region of the sole.

13. The article of claim 7, wherein the side of a selected one of the plurality of projections faces a posterior direction and wherein the selected projection is disposed along the heel region of the sole.

14. The article of claim 7, wherein at least one of the plurality of lugs includes multiple zones that function generally independently of one another.

15. The article of claim 7, wherein the sole includes a toe region and wherein the at least one lug is disposed in the toe region.

16. The article of claim 7, wherein the sole includes a heel region and wherein the at least one of the plurality of lugs is disposed in the heel region.

17. The article of claim 1, further including an outsole affixed to at least a portion of the plate so as to form a ground-engaging surface.

18. The article of claim 17, wherein a first portion of the outsole is affixed to at least one of the cantilever elements of the plate and wherein a second portion of the outsole includes a traction element disposed on a portion of the plate between adjacent cantilever elements.

19. The article of claim 17, wherein the outsole comprises a plurality of separate outsole portions affixed to respective ones of the cantilever elements of the plate.

20. The article of claim 17, wherein the cantilever elements each include a side portion for contacting the side of the corresponding projection and a bottom portion for contacting the bottom of the corresponding projection, and wherein the outsole is affixed to the bottom portion of selected ones of respective cantilever elements.

21. The article of claim 20, wherein the outsole is further affixed to at least the side portions of respective cantilever elements.

22. The article of claim 19, wherein the outsole is further affixed to an exposed portion of at least one of the plurality of projections, the exposed portion being located between the cantilever element and the body portion of the plate.

23. The article of claim 17, wherein the outsole includes a first portion made from a first rubber material and a second portion made from a second rubber material.

24. The article of claim 2, wherein the cantilever elements each include a side portion for contacting the side of the corresponding projection and a bottom portion for contacting the bottom of the corresponding projection, and wherein the side portion of the cantilever element includes a first surface contacting a surface of the side of the corresponding projection and facing a portion of the body of the support portion so as to form an acute angle therebetween, and wherein the bottom portion of the cantilever element includes a first surface contacting a surface of the bottom of the corresponding projection and forming an obtuse angle relative to the first surface of the side portion.

25. An article of footwear comprising an upper and a sole, the sole including:

a plate having a body portion with an opening formed therein, the opening having an edge therealong, and a cantilever element extending from the edge away from the body portion; and a midsole having a support portion substantially contacting a first surface of the body portion of the plate and a projection corresponding to the opening of the plate and extending therethrough, the projection contacting the cantilever element so as to form a lug;

wherein the lug defines a ground contacting portion of the article of footwear.

26. The article of claim 25, wherein the opening comprises a plurality of openings having a plurality of edges therealong, the plurality of cantilever elements comprise a plurality of cantilever elements extending from respective ones of the plurality of edges, the projection comprising a plurality of projections corresponding to respective ones of the plurality of openings of the plate, the plurality of projections contacting respective ones of the cantilever elements so as to form a plurality of lugs.

* * * * *